United States Patent [19]

Shastry et al.

[11] Patent Number: 4,615,732

[45] Date of Patent: Oct. 7, 1986

[54] FE-AL-CR-P-(B,C) AMORPHOUS ALLOY

[75] Inventors: Chakrakodi R. Shastry, Bethlehem; Herbert E. Townsend, Center Valley, both of Pa.

[73] Assignee: Bethlehem Steel Corporation, Bethlehem, Pa.

[21] Appl. No.: 766,729

[22] Filed: Aug. 19, 1985

[51] Int. Cl.[4] ..... C22C 38/06; C22C 38/32; C22C 38/18

[52] U.S. Cl. ..... 148/403; 420/79; 420/103

[58] Field of Search ..... 75/124 E, 124 F, 124 R, 75/126 P, 126 K, 126 A, 126 R; 148/403

[56] References Cited

U.S. PATENT DOCUMENTS 4,052,201 10/1977 Polk et al. ..... 75/126 P
4,298,381 11/1981 Kudo et al. ..... 75/124

FOREIGN PATENT DOCUMENTS 51-4017 1/1976 Japan ..... 75/126 K
59-193248 11/1984 Japan ..... 75/126 K

*Primary Examiner*—L. Dewayne Rutledge
*Assistant Examiner*—Deborah Yee
*Attorney, Agent, or Firm*—William B. Noll

[57] ABSTRACT

A highly corrosion resistant amorphous iron-base alloy having the formula $Fe_aCr_bAl_cP_d(B,C)_e$ where, in a/o:

$a=100-(b+c+d+e)$
$b=4$ to 6
$c=7.5$ to 13
$d=12$ to 14
$e=1$ to 8, and provided further that
$e+d=15$ to 22, and
$e+d+c=27$ to 35.

The alloy has excellent corrosion resistance and is easy to pulverize, thus, making it ideal as a metallic pigment in paints, plasma spray coating powders, and as a filler for plastics.

3 Claims, 1 Drawing Figure

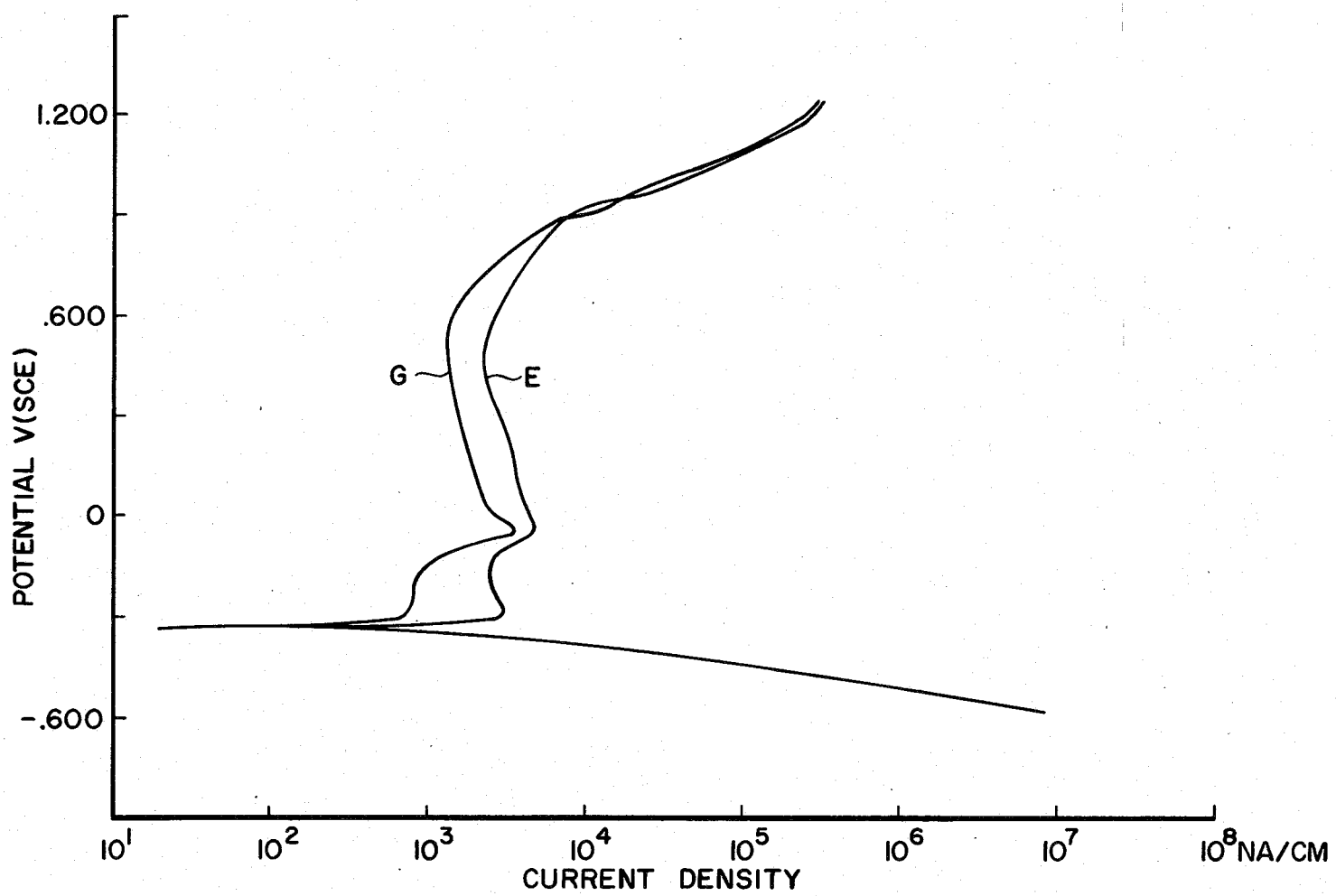
1.200
.600
0
-.600
POTENTIAL V(SCE)
$10^1$
$10^2$
$10^3$
$10^4$
$10^5$
$10^6$
$10^7$
$10^8$NA/CM
CURRENT DENSITY
E
G

FE-AL-CR-P-(B,C) AMORPHOUS ALLOY

BACKGROUND OF THE INVENTION

This invention relates to an iron-base amorphous alloy that has excellent corrosion resistance, and can be readily pulverized for use in such form. Amorphous alloys are typically formed by rapid solidification of the molten metal alloy and are characterized by the absence of any crystalline structure, the conventional structure, i.e. orderly arrangement of atoms, found in ingot cast alloys.

Amorphous alloys have been known for years, particularly in the last decade. A recent development for an iron-base amorphous alloy is taught by Masumoto et al. in U.S. Pat. No. 3,986,867. These alloys contain 1–40 atom percent chromium, 7–35 atom percent of at least one of the metalloids phosphorus, carbon and boron, balance iron, and optionally, also contain less than 40 atom percent of at least one of nickel and cobalt, less than 20 atom percent of at least one of molybdenum, zirconium, titanium and manganese, and less than 10 atom percent of at least one of vanadium, niobium, tungsten, tantalum and copper.

The Masumoto et al alloys are said to provide good mechanical resistance and corrosion resistance. Such alloys are suitable for structural reinforcement members, such as in tires, for example.

A still more recent entry into the field of iron-base amorphous alloys is disclosed by the patent to Kavesh et al in U.S. Pat. No. 4,260,416. These alloys are defined by the composition $Fe_aCr_bC_cP_dMo_eW_fCu_gB_hSi_i$, where "a" ranges from about 61–75 atom percent, "b" ranges from about 6–10 atom percent, "c" ranges from about 11–16 atom percent, "d" ranges from about 4–10 atom percent, "e" ranges from about 0–4 atom percent, "f" ranges from about 0–0.5 atom percent, "g" ranges from about 0–1 atom percent, "h" ranges from about 0–4 atom percent and "i" ranges from about 0–2 atom percent, with the proviso that the sum [c+d+h+i] ranges from 19–24 atom percent and the fraction [c/(c+d+h+i] is less than about 0.84. The alloy is characterized as being strong, ductile, and resistant to corrosion and thermal embrittlement.

For further reference, additional iron-base amorphous alloy are disclosed in the several patents to DeCristofaro et al, namely, U.S. Pat. Nos. 4,249,969 and 4,219,355, and European Patent Application No. 26863.

It is evident from the above described amorphous alloys that the respective alloy system can be complex and thereby present problems in the production of the alloy and its usefulness thereafter. The alloy of the present invention presents a less complex alloy system, while yielding an alloy having excellent corrosion resistance and a low ductility. This combination of properties, to be discussed hereafter in detail, renders the resulting product ideally suited to pulverization and as a filler for paints, plastics, etc.

SUMMARY OF THE INVENTION

The present invention relates to an iron-base alloy having the formula $Fe_aCr_bAl_cP_d(B,C)_e$ where, in a/o:

a=100−(b+c+d+e)
b=4 to 6
c=7.5 to 13
d=12 to 14
e=1 to 8, and provided further that
e+d=15 to 22, and
e+d+c=27 to 35.

The alloy, in an amorphous state, i.e. rapidly quenched or cooled from a molten condition at a rate of at least about 1/ °K./second, exhibits excellent corrosion resistance and a ductility of less than 3.0%. This latter property means the alloy can be readily pulverized and used in pulverulant form as a filler for paints and plastics, or as plasma spray coating powders.

BRIEF DESCRIPTION OF DRAWING

The FIGURE depicts potentiodynamic polarization curves, comparing an alloy of this invention with an alloy of the prior art, where such curves reflect the relative corrosion resistance performance of such alloys in a selected acidic environment.

DETAILED DESCRIPTION OF PREFERRED EMBODIMENT

This invention is directed to a highly corrosion resistant amorphous alloy from the Fe-Al-Cr-P-(B,C) alloy system. The alloy is amorphous in nature produced through rapid solidification. While means for effecting such rapid solidification are known, one technique which may be followed is by ejecting a jet of molten liquid alloy onto a rotating copper wheel, or a device of similar metal or alloy having a high degree of heat conductivity. However, the particular system or technique selected for producing the amorphous alloy of this invention do not form a part thereof. Whatever the method, the rate of solidification should be at least about 1M °K. per second.

The amorphous alloy of this invention consists essentially, in its broadest terms, of an alloy having the formula $Fe_aCr_bAl_cP_d(B,C)_e$ where, in a/o:

a=100−(b+c+d+e)
b=4 to 6
c=7.5 to 13
d=12 to 14
e=1 to 8, and provided further that
e+d=15 to 22, and
e+d+c=27 to 35.

Within such alloy system, it was discovered that an unexpected high level of corrosion resistance resulted from the combination of high aluminum with low chromium. Thus, a preferred system is one where:

b=4 to 5
c=7.5 to 10.

To demonstrate such combination of aluminum and chromium, and to show the general performance of the alloys of this invention, a series of iron-base amorphous alloys, and a conventionally produced stainless steel, were prepared and subjected to a number of corrosion tests. The amorphous alloys (composition and corrosion performance), designated A, C-H and K, are listed below in TABLE I. The stainless steel standard, designated L, was conventionally produced and possesses a crystalline structure. The remaining alloys, designated B and J, are respectively crystalline and partially amorphous.

TABLE I

| Composition and Corrosion Performance | | | | | | | | | | | | | |
|---|---|---|---|---|---|---|---|---|---|---|---|---|---|
| | Alloy Composition[1] | | | | | | | | Corrosion Rate, mm/yr.[2] (168 hr., 25 C) | | | | |
| Alloy | Fe | Cr | Al | Si | Ni | P | B | C | 1 N $H_2SO_4$ | 1 N NaCl | 0.1 N HCl | 0.5 N HCl | 1 N HCl |
| A | 67 | | 13 | | | 13 | 7 | | 0.432 | 0.007 | 0.102 | — | — |
| B | 67 | | 13 | 13 | | 7 | | | Dissolved | 0.002 | 0.476 | — | — |
| C | 72 | 1 | 7 | | | 13 | | 7 | 0.140 | 0.001 | 0.006 | — | — |
| D | 63 | 2 | 13 | | 2 | 13 | 7 | | — | 0.000 | 0.089 | — | — |
| E | 72 | 4 | 4 | | | 13 | | 7 | 0.000 | 0.000 | 0.000 | 0.000 | 0.000 |
| F | 67 | 4 | 9 | | | 13 | 7 | | 0.067 | 0.000 | 0.003 | — | — |
| G | 67 | 4 | 9 | | | 13 | | 7 | 0.000 | 0.000 | 0.000 | 0.000 | 0.000 |
| H | 63 | 4 | 13 | | | 13 | 7 | | 0.078 | 0.000 | 0.006 | — | — |
| J | 63 | 4 | 18 | | | 10 | 5 | | 0.474 | 0.000 | 0.134 | — | — |
| K | 70 | 4 | 6 | | | 13 | | 7 | 0.012 | 0.000 | — | — | 0.487 |
| L | Stainless Steel Type 304 | | | | | | | | 0.004 | 0.004 | 0.008 | — | 0.648 |

[1]atomic percent
[2]mm/yr. = millimeters per year.

The optimum alloy shown in TABLE I, and coming within the scope of this invention is Alloy G. An alloy not within this invention, which appears to show good performance, is Alloy E. In simple terms, comparing the composition of Alloy E with Alloy G, the iron was replaced by the addition of aluminum. Despite the apparent similarities in performance, Alloy G has a higher corrosion resistance than Alloy E. This difference is clear from the data presented in The FIGURE. The data are from the potentiodynamic polarization curves for Alloys G and E, where such data is generated by determining the current density against potential in a deaerated solution of I.ON $H_2SO_4$ at 25° C. The passive current density is a commonly employed measure for comparing the corrosion resistance of alloys exhibiting an active-passive type corrosion behavior. In the present case, the passive current density, or equivalently, the alloy dissolution rate for Alloy G is only one third that of Alloy E. In different terms, Alloy G has three times higher corrosion resistance than Alloy E under moderately oxidizing conditions characterized by corrosion potential of alloys in the −100 to −300 mv (versus saturated calomel electrode) range of the passive region. Even under somewhat more strongly oxidizing conditions, characterized by higher corrosion potentials, the corrosion resistance of Alloy G is significantly higher than that of Alloy E.

Another measure of corrosion performane of alloys exhibiting active-passive type corrosion behavior is the critical anodic current density. This is the value of current density which must be exceeded to make an actively corroding alloy passive or corrosion resistant. An alloy with a lower critical current density is more readily passivated and hence has a better corrosion resistance than an alloy with a higher critical current density. The critical current density for Alloy G is 0.88 $\mu A/cm^2$ whereas for Alloy E it is 32 $\mu A/cm^2$ Alloy G thus has a superior resistance to corrosion when compared to Alloy E.

Another distinct advantage of Alloy G over Alloy E is that it is significantly easier to pulverize due to a lower ductility. Certain physical properties of the two alloys, along with intermediate Alloy K, are presented in TABLE II.

TABLE II

| Physical Properties | | |
|---|---|---|
| Alloy | Bend dia. at failure | Fracture Strain in bending $\% = \frac{t}{d+t} \times 100$ |
| E | 4 t | 20% |
| G | 37 t | 2.6% |
| K | 6 t | 14.3% |

From the data of Table II it will be noted that the increase in Al from 4 a/o to 6 a/0 (Alloys E and K) resulted in only an insignificant drop in ductility as measured by the slight change in bend diameter to produce a failure in the test piece. However, by the further increase in Al to 9 a/o (Alloy G), the alloy becomes quite brittle. As a consequence of this brittleness, Alloy G can be readily pulverized. In such a state, the alloy can be used as a metal additive for paints, plastics, and as a coating powder for plasma spray applications.

We claim:

1. An iron-chromium-aluminum-phosphorus series amorphous alloy having improved corrosion resistance, and the ability to be readily pulverized, consisting essentially of an alloy having the formula $Fe_aCr_bAl_cP_d(B,C)_e$ where, in a/o:

$a=100-(b+c+d+e)$
$b=4$ to 6
$c=7.5$ to 10
$d=12$ to 14
$e=1$ to 8, and provided further that
$e+d=15$ to 22, and
$e+d+c=27$ to 35.

2. The alloy of claim 1 wherein $b=4$ to 5.

3. The alloy of claim 1 characterized by a ductility having a fracture strain in bending of less than 3.0%.

* * * * *